US009784291B2

(12) United States Patent
Funato

(10) Patent No.: US 9,784,291 B2
(45) Date of Patent: Oct. 10, 2017

(54) FLUID PRESSURE CYLINDER

(75) Inventor: Hiroshi Funato, Gifu (JP)

(73) Assignee: KYB Corporation, Tokyo (JP)

( * ) Notice: Subject to any disclaimer, the term of this patent is extended or adjusted under 35 U.S.C. 154(b) by 620 days.

(21) Appl. No.: 13/578,381

(22) PCT Filed: Feb. 1, 2011

(86) PCT No.: PCT/JP2011/052063

§ 371 (c)(1),
(2), (4) Date: Aug. 10, 2012

(87) PCT Pub. No.: WO2011/099402

PCT Pub. Date: Aug. 18, 2011

(65) Prior Publication Data

US 2012/0304855 A1 Dec. 6, 2012

(30) Foreign Application Priority Data

Feb. 15, 2010 (JP) ..... 2010-029882

(51) Int. Cl.
*F16J 15/00* (2006.01)
*F15B 15/14* (2006.01)

(52) U.S. Cl.
CPC ..... *F15B 15/1452* (2013.01)

(58) Field of Classification Search
CPC ..... F15B 15/1452; F15B 15/1447; F16J 1/02; F16J 1/04; F16J 1/06; F16J 9/064; F16J 9/16; F16J 9/18
USPC ..... 92/248–253
See application file for complete search history.

(56) References Cited

U.S. PATENT DOCUMENTS 2,295,521 A * 9/1942 Payne et al. ..... 92/248
2,344,687 A * 3/1944 Fischer et al. ..... 92/252
2,797,971 A * 7/1957 Greenough ..... 277/448
3,312,150 A * 4/1967 Strader ..... 92/252
3,443,486 A * 5/1969 Lanman ..... 92/244
3,582,093 A * 6/1971 Lucien ..... F16J 15/166 277/434

(Continued)

FOREIGN PATENT DOCUMENTS

DE 1129019 B * 5/1962 ..... F16J 1/02
DE 2315016 A1 * 3/1973 ..... F16J 1/06

(Continued)

OTHER PUBLICATIONS

Office Action dated Nov. 28, 2013, corresponds to Korean patent application No. 10-2012-7023931.

(Continued)

*Primary Examiner* — Thomas E Lazo
*Assistant Examiner* — Matthew Wiblin
(74) *Attorney, Agent, or Firm* — Hauptman Ham, LLP

(57) ABSTRACT

A piston of a fluid pressure cylinder comprises a sealing ring interposed in a sealing ring accommodation groove, a piston ring that is interposed in a piston ring accommodation groove of the piston and comprises a fractured portion, and a backup ring that is attached to an outer peripheral surface of the piston and contacts the sealing ring and the piston ring. A groove for holding the backup ring is not required, and therefore a diameter of the piston can be reduced relative to the sealing ring. As a result, attachment of the sealing ring to the piston is simplified.

12 Claims, 5 Drawing Sheets

(56) References Cited

U.S. PATENT DOCUMENTS

| | | | | |
|---|---|---|---|---|
| 3,653,303 | A | 4/1972 | Zurcher | |
| 3,974,745 | A * | 8/1976 | Godmaire | 92/127 |
| 4,003,297 | A | 1/1977 | Mott | |
| 4,086,844 | A * | 5/1978 | Homuth | 91/418 |
| 4,207,800 | A | 6/1980 | Homuth | |
| 5,284,084 | A * | 2/1994 | Pippert | E21B 21/01 92/241 |
| 5,934,175 | A * | 8/1999 | Vatel | 92/252 |
| 6,182,974 | B1 * | 2/2001 | Harrelson, III | 277/537 |
| 8,794,638 | B2 * | 8/2014 | Tuckness et al. | 277/638 |

FOREIGN PATENT DOCUMENTS

| | | | | |
|---|---|---|---|---|
| DE | 2320736 | A1 * | 2/1975 | F16J 1/02 |
| DE | 102007051414 | A1 | 4/2008 | |
| EP | 0219689 | A2 * | 9/1985 | F16J 15/166 |
| EP | 1985895 | A2 | 10/2008 | |
| GB | 901990 | A * | 7/1962 | F16J 1/04 |
| JP | 56087604 | U | 7/1981 | |
| JP | 58070504 | U | 5/1983 | |
| JP | 59098157 | U | 7/1984 | |
| JP | 62016865 | U | 1/1987 | |
| JP | 7133866 | A | 5/1995 | |
| JP | 200190711 | A | 4/2001 | |

OTHER PUBLICATIONS

International Search Report corresponding to PCT/JP2011/052063, dated Mar. 15, 2011.

Extended European Search Report issued Feb. 20, 2014, corresponds to European patent application No. 11742147.9.

* cited by examiner

FLUID PRESSURE CYLINDER

RELATED APPLICATIONS

The present application is a National Phase of International Application Number PCT/JP2011/052063, filed Feb. 1, 2011, and claims priority from Japanese Application Number 2010-029882, filed Feb. 15, 2010.

FIELD OF THE INVENTION

This invention relates to a sealing structure for a piston accommodated in a fluid pressure cylinder.

BACKGROUND OF THE INVENTION

A sealing ring that slides against a cylinder tube is attached to a piston that is accommodated in a fluid pressure cylinder so as to define an oil chamber within the fluid pressure cylinder. For this purpose, a ring-shaped accommodation groove that holds the sealing ring is formed in an outer periphery of the piston.

To attach the sealing ring to the piston, a diameter of the sealing ring is increased using an attachment jig, whereupon the sealing ring is guided into the accommodation groove along the outer periphery of the piston. Having reached a periphery of the accommodation groove, the diameter of the sealing ring is reduced using a correction jig, whereby the sealing ring is fitted into the accommodation groove.

Hence, the sealing ring is attached to the piston using a plurality of jigs, and therefore an increase in a number of steps required to assemble the piston is unavoidable.

SUMMARY OF THE INVENTION

JP62-016865U, published by the Japan Patent Office in 1987, proposes simplifying attachment of the sealing ring by dividing the piston.

According to this proposal, attachment of the sealing ring is simplified, but the structure of the piston becomes more complicated.

It is therefore an object of this invention to simplify attachment of a sealing ring to a piston without complicating the structure of the piston.

In order to achieve this object, a fluid pressure cylinder according to this invention comprises a cylinder tube having a central axis and an inner peripheral surface that is cylindrical about the central axis, a piston that is accommodated in the cylinder tube, slides against the inner peripheral surface of the cylinder tube and defines a fluid chamber within the cylinder tube, a sealing ring held in a sealing ring accommodation groove formed in a circumferential direction in an outer peripheral surface of the piston, a piston ring that is held in a piston ring accommodation groove formed in the circumferential direction in the outer peripheral surface of the piston and comprises a fractured portion with which a diameter thereof can be increased and reduced, and a backup ring that is attached to an outer periphery of the piston between the sealing ring and the piston ring such that respective ends thereof relative to the central axis direction contact the sealing ring and the piston ring.

The details as well as other features and advantages of this invention are set forth in the remainder of the specification and are shown in the accompanying drawings.

DESCRIPTION OF THE PREFERRED EMBODIMENTS

Figure 1:
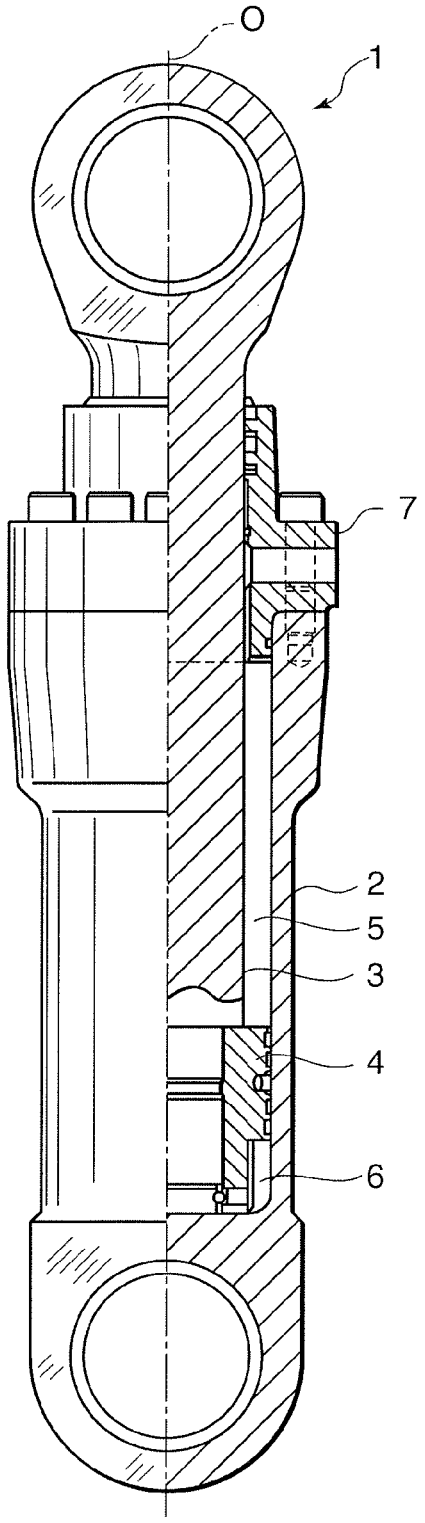
FIG. 1 is a longitudinal sectional view including a partial side view of a hydraulic cylinder according to a first embodiment of this invention.

Referring to FIG. 1 of the drawings, a hydraulic cylinder 1 that uses oil as a working fluid comprises a cylinder tube 2, a piston 4 accommodated inside the cylinder tube 2 to be capable of sliding, and a piston rod 3 that is joined to the piston 4 so as to project from the cylinder tube 2 in an axial direction. The piston rod 3 projects to an exterior of the cylinder tube 2 so as to be free to slide via a cylinder head 7 provided on an open end of the cylinder tube 2.

The hydraulic cylinder 1 is used as an actuator in a construction machine or an operating machine, for example. A replacement aqueous fluid or gas may be used instead of oil as the working fluid.

The cylinder tube 2, the piston rod 3, the piston 4, and the cylinder head are disposed coaxially relative to a central axis O of the cylinder tube 2 and the piston 4.

An interior of the cylinder tube 2 is divided by the piston 4 into a piston rod side oil chamber 5 and an opposite side oil chamber 6. The oil chambers 5 and 6 are respectively connected to an oil pressure source via pipes. The hydraulic cylinder 1 performs a contraction operation in response to a supply of working oil from the oil pressure source to the oil chamber 5 and performs an expansion operation in response to a supply of working oil from the oil pressure source to the oil chamber 6.

Figure 2:
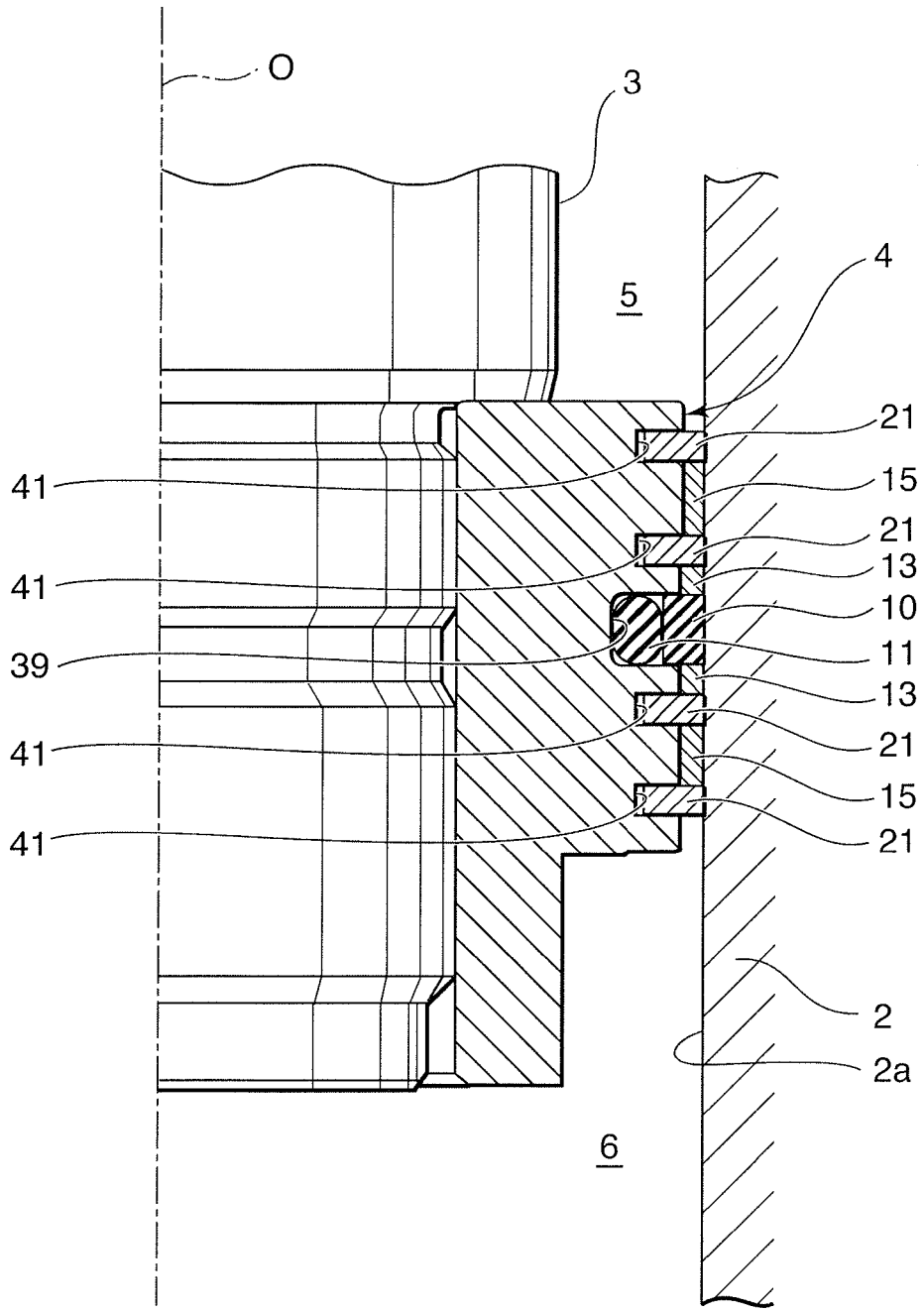
FIG. 2 is a longitudinal sectional view of main parts of the hydraulic cylinder.

Referring to FIG. 2, various rings that slide against an inner peripheral surface 2*a* of the cylinder tube 2 are attached to an outer periphery of the piston 4. More specifically, a piston ring 21, a bearing ring 15, a piston ring 21, a backup ring 13, a sealing ring 10, a backup ring 13, a piston ring 21, a bearing ring 15, and a piston ring 21 are disposed in that order from a top to a bottom of the figure.

Figure 3:
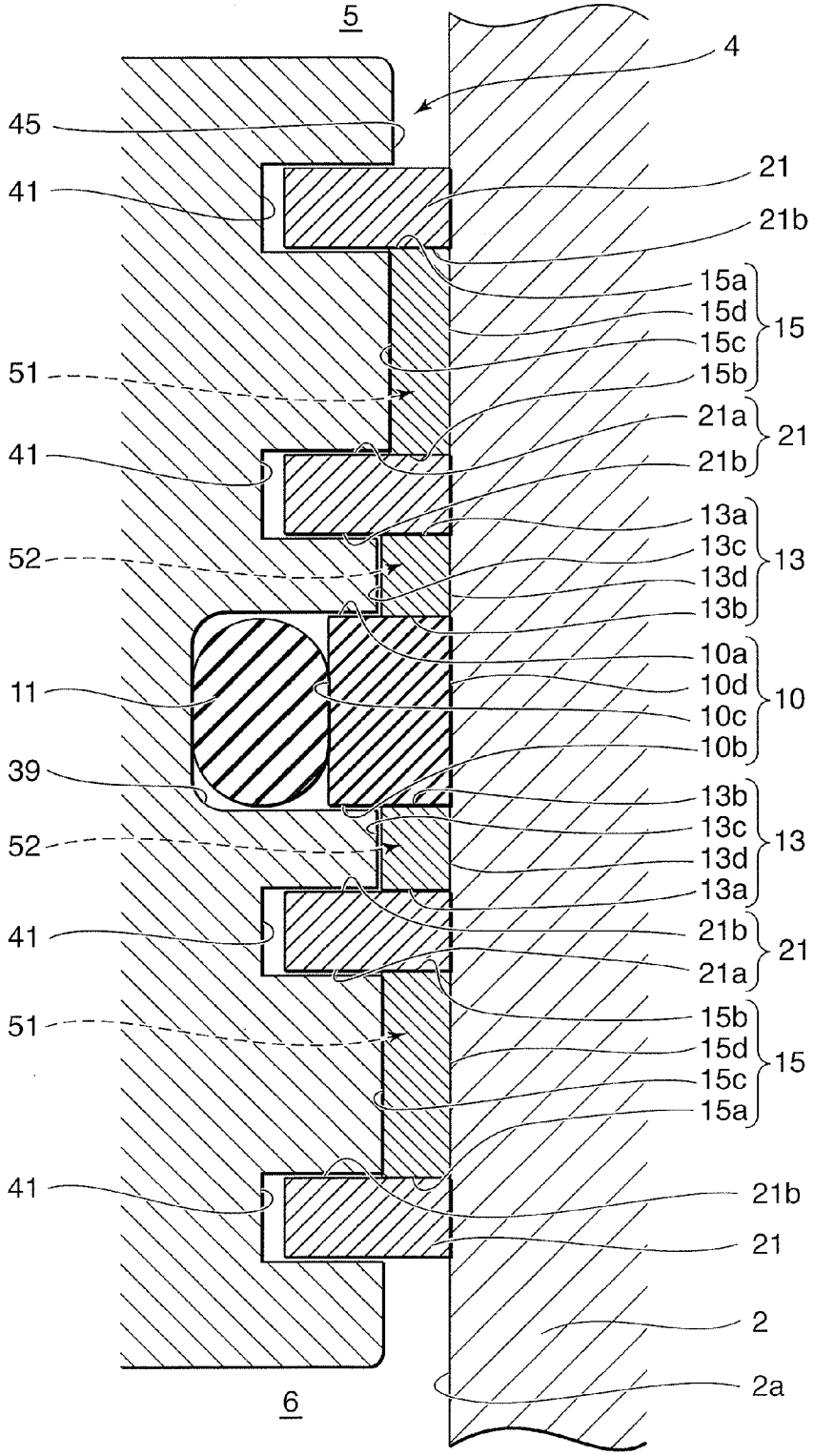
FIG. 3 is an enlarged longitudinal sectional view of main parts of a piston according to the first embodiment of this invention.

Referring to FIG. 3, four piston ring accommodation grooves 41 are formed in parallel in an outer peripheral surface 45 of the piston 4 so as to be continuous in a circumferential direction. The piston rings 21 are inserted into the piston ring accommodation grooves 41.

The piston rings 21 are constructed using a metal such as a steel material, and have a rectangular cross-section.

Figure 4:
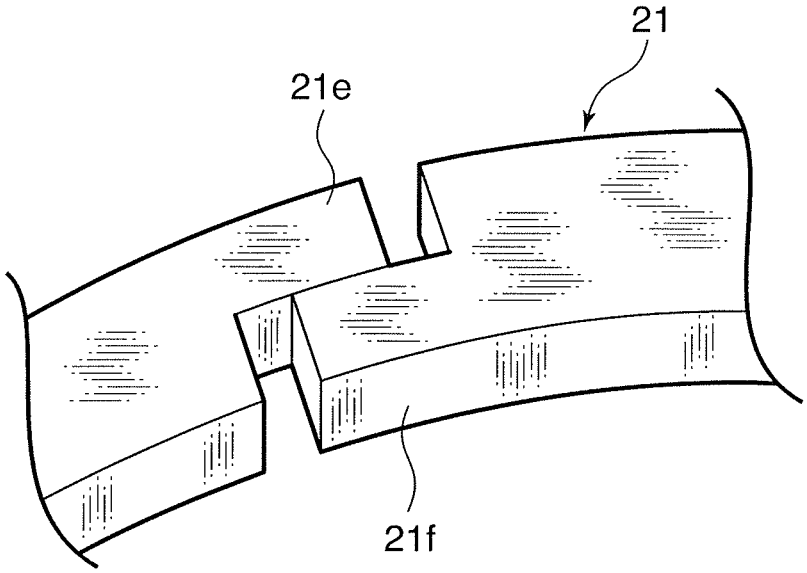
FIG. 4 is a perspective view of a fractured portion of a piston ring according to the first embodiment of this invention.

Referring to FIG. 4, the piston ring 21 comprises a fractured portion in a single location thereof. The fractured portion is constituted by end portions 21*e* and 21*f* of the piston ring 21. The end portions 21*e* and 21*f* respectively comprise L-shaped cutouts. By inserting the end portion 21*f* into the cutout on the end portion 21*e* and inserting the end portion 21*e* into the cutout on the end portion 21*f*, the end portions 21*e* and 21*f* overlap while remaining physically fractured. An amount of overlap varies in accordance with expansion and contraction of the piston ring 21. The overlap prevents a gap from forming between the end portions 21*e* and 21*f*, and therefore secures a continuity of the piston ring 21.

The fractured portion of the piston ring 21 is not limited to the shape described above, and other shapes, including a bias cut, may be employed.

The piston rings 21 are inserted into the respective piston ring accommodation grooves 41 in a state where the fractured portion is expanded, or in other words a state where the overlap between the end portions 21*e* and 21*f* is small. The piston rings 21 are then fitted to the piston ring accommodation grooves 41 by contracting the fractured portion. According to this attachment structure, the piston 4 need not be divided, and the piston rings 21 can be fitted to the piston ring accommodation grooves 41 easily.

Referring back to FIG. 3, the piston ring 21 comprises an inner peripheral portion that is fitted to the piston ring accommodation groove 41, and an outer peripheral portion that projects from the piston ring accommodation groove 41 toward the inner peripheral surface 2*a* of the cylinder tube 2.

The outer peripheral portion of the piston ring 21 is caused to contact the inner peripheral surface 2*a* of the cylinder tube 2 around the entire circumference thereof by an elastic restoring force exerted in a direction for widening the fractured portion, or in other words a diameter increasing direction. This contact between the piston ring 21 and the inner peripheral surface 2*a* of the cylinder tube 2 enables the piston ring 21 to function as a contamination sealing ring that prevents contamination matter contained in the working oil from infiltrating a sliding contact portion between the sealing ring 10 and the inner peripheral surface 2*a* of the cylinder tube 2. The piston ring 21 also realizes a buffering function for ensuring that a high pressure generated in the piston rod side oil chamber 5 or the opposite side oil chamber 6 is not exerted directly on the sealing ring 10.

The bearing rings 15 are constituted by synthetic resin such as polyimide resin, and have a rectangular cross-section. The bearing rings 15 are formed as continuous rings not having a fractured portion, and are fitted to the outer periphery of the piston 4. An outer peripheral surface 15*d* of the bearing ring 15 contacts the inner peripheral surface 2*a* of the cylinder tube 2, thereby supporting the piston 4 to be capable of sliding relative to the cylinder tube 2. A fractured portion may be provided likewise in the bearing ring 15.

The bearing rings 15 are disposed respectively between the piston rings 21. One end surface 15*a* of the bearing ring 15 contacts an inwardly oriented end surface 21*b* of the piston rings 21 on an upper end and a lower end of the figure, while another end surface 15*b* of the bearing ring 15 contacts an end surface 21*a* located on an opposite side to the sealing ring 10 of the piston rings 21 positioned close to the sealing ring 10. An inner peripheral surface 15*c* of the bearing ring 15 contacts the outer peripheral surface 45 of the piston 4.

As a result, an annular bearing ring accommodation portion 51 for accommodating the bearing ring 15 is defined by the end surface 21*b* of one piston ring 21, the end surface 21*a* of another piston ring 21, and the outer peripheral surface 45 of the piston 4.

Hence, each bearing ring 15 is sandwiched from above and below in the figure by two piston rings 21. The two piston rings 21 serve to restrict displacement of the bearing ring 15 relative to the piston 4 in a central axis O direction of the cylinder tube 2.

A single annular sealing ring accommodation groove 39 is formed in a center of the outer peripheral surface 45 of the piston 4 so as to be positioned between the upper two piston ring accommodation grooves 41 and the lower two piston ring accommodation grooves 41 in the figure. An O-ring 11 and the sealing ring 10 are inserted into the sealing ring accommodation groove 39.

The O-ring 11 is constructed using an elastically deforming material such as rubber, for example, and has a circular cross-sectional shape. The O-ring 11 is formed as a continuous ring not having a fractured portion. The O-ring 11 is disposed on an inner side, or in other words the central axis O side, of the sealing ring 10 within the sealing ring accommodation groove 39. An elastic restoring force of the O-ring 11 presses an inner peripheral surface 10*c* of the sealing ring 10, and as a result, the sealing ring 10 is biased toward an outer side.

The sealing ring 10 is constituted by a synthetic resin material such as polytetrafluoroethylene (PTFE), and has a rectangular cross-section. The sealing ring 10 is formed as a continuous ring not having a fractured portion. The sealing ring 10 comprises a fitted portion that is fitted into the sealing ring accommodation groove 39, and a projecting portion that projects outward from the sealing ring accommodation groove 39. An outer peripheral surface 10*d* of the projecting portion of the sealing ring 10 contacts the inner peripheral surface 2*a* of the cylinder tube 2 around the entire circumference thereof, whereby the sealing ring 10 serves to cut off the piston rod side oil chamber 5 from the opposite side oil chamber 6.

The backup rings 13 are interposed respectively between the two piston rings 21 close to the sealing ring 10 and the sealing ring 10. The backup rings 13 are formed as continuous rings not having a fractured portion, and have a rectangular cross-section. A fractured portion may be provided likewise in the backup rings 13.

The backup ring 13 is formed to have a smaller radial direction thickness than the sealing ring 10.

One end surface 13*a* of the backup ring 13 contacts the end surface 21*b* of the piston ring 21, and another end surface 13*b* of the backup ring 13 contacts an end surface 10*a* or 10*b* of the sealing ring 10. An inner peripheral surface 13*c* of the backup ring 13 contacts the outer peripheral surface 45 of the piston 4, and an outer peripheral surface 13*d* of the backup ring 13 contacts the inner peripheral surface 2*a* of the cylinder tube 2.

In other words, an annular backup ring accommodation portion 52 for accommodating the backup ring 13 is defined by the end surface 21*b* of the piston ring 21 close to the sealing ring 10, the end surface 10*a* or 10*b* of the sealing ring 10, and the outer peripheral surface 45 of the piston 4.

By having the end surface 13*b* of the backup ring 13 contact the end surface 10*a* or 10*b* of the sealing ring 10, the backup ring 13 serves to suppress deformation of an outer peripheral edge of the sealing ring 10. The radial direction thickness of the backup ring 13 may be set to be equal to a thickness of the bearing ring 15. A load exerted parallel to the central axis O on the sealing ring 10 during an operation of the hydraulic cylinder 1 is supported by the piston rings 21 via the backup rings 13.

The piston 4 having the sealing structure described above is assembled in a following sequence, for example.

(1) The O-ring 11 and the sealing ring 10 are inserted into the sealing ring accommodation groove 39 of the piston 4.

The O-ring 11, which is constituted by an elastically deforming material, is increased in diameter by elastic deformation and passed over the outer periphery of the piston 4 in this condition until it reaches the sealing ring accommodation groove 39. The diameter of the O-ring 11 is then reduced due to the elastic restoring force thereof, whereby the O-ring 11 is fitted to the sealing ring accommodation groove 39.

The sealing ring 10, which is constituted by a synthetic resin material, is likewise increased in diameter mainly by elastic deformation and passed over the outer periphery of the piston 4 in this condition until it is fitted to the sealing ring accommodation groove 39. At this stage, the piston rings 21 are not attached to the piston 4, and therefore the diameter of the sealing ring 10 does not have to be increased greatly in order to pass the sealing ring 10 over the piston rings 21. The assembly sequence is preferably set in this way to prevent plastic deformation of the sealing ring 10 when the diameter thereof is increased. According to this process, a step of reducing the diameter of the sealing ring 10 using a correction jig is not required when the sealing ring 10 is attached to the sealing ring accommodation groove 39.

(2) The two backup rings 13 are fitted to the outer peripheral surface 45 of the piston 4 so as to contact the end surfaces 10*a* and 10*b* of the sealing ring 10, respectively.

(3) Two of the piston rings 21 are inserted respectively into the two piston ring accommodation grooves 41 on the sealing ring side by widening the respective fractured portions of the piston rings 21 and passing the piston rings 21 over the outer periphery of the piston 4 until the piston rings 21 are respectively adjacent to the two backup rings 13. Thereafter, the two piston rings 21 function as members for retaining and supporting the backup rings 13.

(4) The two bearing rings 15 are respectively fitted to the outer peripheral surface 45 of the piston 4 so as to contact the respective piston rings 21.

(5) The respective fractured portions of the remaining two piston rings 21 are widened, and in this condition, the piston rings 21 are attached respectively to the two piston ring accommodation grooves 41 disposed at a remove from the sealing ring 10. These two piston rings 21 function as members for retaining and supporting the bearing rings 15.

It should be noted that the procedure for assembling the piston 4 is not limited to that described above. For example, the piston ring 21, the bearing ring 15, the piston ring 21, the backup ring 13, the sealing ring 10, the backup ring 13, the piston ring 21, the bearing ring 15, and the piston ring 21 may be attached to the piston 4 in that order from the top or the bottom of FIG. 3. Likewise in this case, the sealing ring 10 does not have to pass over other rings when being attached to the piston 4, and therefore deformation occurring when the diameter of the sealing ring 10 is increased can be minimized.

The piston rings 21 function as follows:

- as a member to define the backup ring accommodation portion 52;
- as contamination sealing rings that prevent contamination matter contained in the working oil from infiltrating the contact portion between the sealing ring 10 and the inner peripheral surface 2*a* of the cylinder tube 2;
- as a member to suppress infiltration of air bubbles in the working oil into the contact portion between the sealing ring 10 and the inner peripheral surface 2*a* of the cylinder tube 2, thereby preventing damage to the sealing ring 10 caused when the working oil is burned by heat of compression from the air bubbles; and
- as buffer rings that prevent the high pressure generated in the piston rod side oil chamber 5 or the opposite side oil chamber 6 from acting directly on the sealing ring 10.

According to the sealing structure described above, there is no need to provide accommodation grooves for the backup rings 13, independent contamination sealing rings, and independent buffer rings. By eliminating the need for accommodation grooves for the backup rings 13, a diameter of the piston 4 can be reduced relative to the diameter of the sealing ring 10 by an amount corresponding to a depth of the accommodation grooves. As a result, a number of cutting steps implemented on the piston 4 to form the accommodation grooves is reduced.

Further, a gap between the outer peripheral surface 45 of the piston 4 and the inner peripheral surface 2*a* of the cylinder tube 2 can be increased such that when a load is exerted on the piston 4 in a lateral direction, the outer peripheral surface 45 of the piston 4 is less likely to collide with the inner peripheral surface 2*a* of the cylinder tube 2.

Furthermore, when the diameter of the piston 4 is reduced, a depth by which the sealing ring 10 is fitted to the sealing ring accommodation groove 39 becomes shallower, and therefore the amount of deformation applied to the sealing ring 10 in order to increase the diameter thereof during attachment to the piston 4 can be reduced correspondingly. When the amount of deformation applied to increase the diameter is reduced, the need for an operation to reduce the diameter of the sealing ring 10 using a dedicated correction jig during attachment of the sealing ring to the sealing ring accommodation groove 39 can be eliminated. As a result, attachment of the sealing ring 10 to the piston 4 is simplified.

The continuous bearing ring 15 not having a fractured portion is simply fitted to the outer periphery of the piston 4, and therefore the diameter of the bearing ring 15 does not have to be increased in order to attach the bearing ring 15 to the piston 4.

Figure 5:
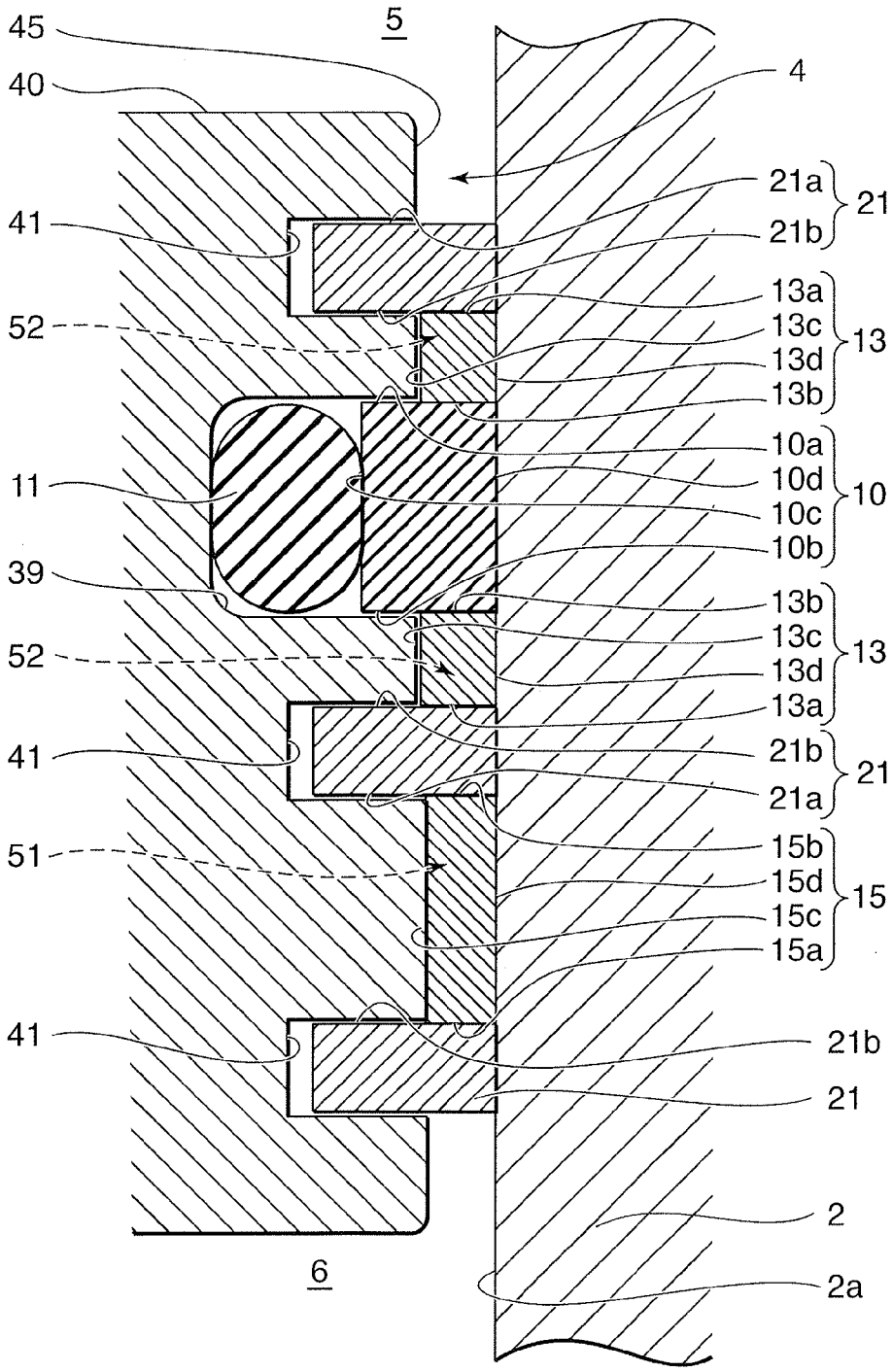
FIG. 5 is a longitudinal sectional view of main parts of a hydraulic cylinder according to a second embodiment of this invention.

Referring to FIG. 5, another embodiment of this invention will be described.

The piston 4 according to this embodiment differs from the piston 4 of the first embodiment in that the piston ring 21 and the bearing ring 15 close to the piston rod side oil chamber 5 have been omitted.

The piston ring 21, the backup ring 13, the sealing ring 10, the backup ring 13, the piston ring 21, the bearing ring 15, and the piston ring 21 are disposed between the outer peripheral surface 45 of the piston 4 and the inner peripheral surface 2*a* of the cylinder tube 2 in that order from a top to a bottom of the figure.

In this embodiment, the piston 4 slides against the cylinder tube 2 via the single bearing ring 15, and therefore a dimension of the piston 4 in the central axis O direction of the cylinder tube 2 can be reduced, enabling an increase in an effective stroke of the hydraulic cylinder 1.

Although the invention has been described above with reference to certain embodiments, the invention is not limited to the embodiments described above. Modifications and variations of the embodiments described above will occur to those skilled in the art, within the scope of the claims.

For example, in the above embodiments, this invention is applied to the piston 4 of the double acting hydraulic cylinder 1, but the invention may also be applied to a single acting fluid pressure cylinder. In a single acting fluid pressure cylinder, only one of the piston rod side oil chamber and the opposite side oil chamber is filled with a pressurized working fluid, and therefore the backup ring need only be provided on one side of the sealing ring on the piston of the single acting fluid pressure cylinder.

INDUSTRIAL FIELD OF APPLICATION

The fluid pressure cylinder according to this invention may be used in a hydraulic device, a pneumatic device, and so on of a construction machine or an operating machine.

The embodiments of this invention in which an exclusive property or privilege is claimed are defined as follows:

1. A fluid pressure cylinder, comprising:

a cylinder tube having a central axis and an inner peripheral surface that is cylindrical about the central axis;

a piston that is accommodated in the cylinder tube, is slidable against the inner peripheral surface of the cylinder tube, and defines a first side chamber and an opposite, second side chamber within the cylinder tube;

a sealing ring held in a sealing ring accommodation groove formed in a circumferential direction in an outer peripheral surface of the piston, the sealing ring configured to cut off the first side chamber from the opposite, second side chamber;

a first piston ring that is held in a first piston ring accommodation groove formed in the circumferential direction in the outer peripheral surface of the piston, and includes a fractured portion which enables a diameter of the first piston ring to increase and reduce;

a second piston ring that is held in a second piston ring accommodation groove formed in the circumferential direction in the outer peripheral surface of the piston, and includes a fractured portion which enables a diameter of the second piston ring to increase and reduce, wherein the first piston ring accommodation groove is located between the second piston ring accommodation groove and the sealing ring accommodation groove;

a backup ring that is attached, without being accommodated in a groove, to the outer peripheral surface of the piston between the sealing ring and the first piston ring, wherein the backup ring has a first backup ring end and a second backup ring end opposite to each other in a central axis direction, the first backup ring end is kept in constant contact with the sealing ring and, simultaneously, the second backup ring end is kept in constant contact with the first piston ring to enable the first piston ring to support a load exerted, via the backup ring, on the sealing ring in the central axis direction; and a bearing ring that is attached, without being accommodated in a groove, to the outer peripheral surface of the piston between the first piston ring and the second piston ring, the bearing ring configured to support the piston slidably relative to the cylinder tube, wherein the bearing ring has a first bearing ring end and a second bearing ring end opposite to each other in the central axis direction, the first bearing ring end is kept in constant contact with the first piston ring and, simultaneously, the second bearing ring end is kept in constant contact with the second piston ring.

2. The fluid pressure cylinder as defined in claim 1, wherein the backup ring, the bearing ring, the second piston ring and the first piston ring are disposed on the piston on a first side of the sealing ring relative to the central axis direction, and the fluid pressure cylinder further comprises, on a second side of the sealing ring which is opposite to the first side in the central axis direction:

a further first piston ring that is held in a further first piston ring accommodation groove formed in the circumferential direction in the outer peripheral surface of the piston, and includes a fractured portion which enables a diameter of the further first piston ring to increase and reduce;

a further second piston ring that is held in a further second piston ring accommodation groove formed in the circumferential direction in the outer peripheral surface of the piston, and includes a fractured portion which enables a diameter of the further second piston ring to increase and reduce, wherein the further first piston ring accommodation groove is located between the further second piston ring accommodation groove and the sealing ring accommodation groove;

a further backup ring that is attached, without being accommodated in a groove, to the outer peripheral surface of the piston between the sealing ring and the further first piston ring, wherein the further backup ring has a first further backup ring end and a second further backup ring end opposite to each other in the central axis direction, the first further backup ring end is kept in constant contact with the sealing ring and, simultaneously, the second further backup ring end is kept in constant contact with the further first piston ring; and a further bearing ring that is attached, without being accommodated in a groove, to the outer peripheral surface of the piston between the further first piston ring and the further second piston ring, wherein the further bearing ring has a first further bearing ring end and a second further bearing ring end opposite to each other the central axis direction, the first further bearing ring end is kept in constant contact with the further first piston ring and, simultaneously, the second further bearing ring end is kept in constant contact with the further second piston ring.

3. The fluid pressure cylinder as defined in claim 2, wherein the piston has first and second axial ends opposite to each other in the center axis direction, the first axial end is on the first side of the sealing ring, and the second axial end is on the second side of the sealing ring, each of the sealing ring accommodation groove, the first piston ring accommodation groove, the second piston ring accommodation groove, the further first piston ring accommodation groove, and the further second piston ring accommodation groove is formed in the outer peripheral surface of the piston between the first and second axial ends, and not at the first and second axial ends, the outer peripheral surface of the piston has no groove between the second piston ring accommodation groove and the first axial end, and the outer peripheral surface of the piston has no groove between the further second piston ring accommodation groove and the second axial end.

4. The fluid pressure cylinder as defined in claim 3, wherein the sealing ring comprises an elastically deformable material, each of the first piston ring, the second piston ring, the further first piston ring, and the further second piston ring comprises a metal material, and each of the bearing ring and the further bearing ring comprises synthetic resin.

5. The fluid pressure cylinder as defined in claim 1, wherein the sealing ring comprises an elastically deformable material.

6. The fluid pressure cylinder as defined in claim 5, wherein the first piston ring and the second piston ring comprise a metal material.

7. The fluid pressure cylinder as defined in claim 6, wherein the bearing ring comprises synthetic resin.

8. The fluid pressure cylinder as defined in claim 1, wherein the piston has axial ends relative to the center axis direction, and each of the sealing ring accommodation groove, the first piston ring accommodation groove, and the second piston ring accommodation groove is formed in the outer peripheral surface of the piston other than the axial ends.

9. The fluid pressure cylinder as defined in claim 1, wherein the fractured portion of the first piston ring is constituted by end portions of the first piston ring and the fractured portion of the second piston ring is constituted by end portions of the second piston ring, and the end portions of the first piston ring and the end portions of the second piston ring respectively have L-shaped cutouts.

10. The fluid pressure cylinder as defined in claim 1, wherein the backup ring, the bearing ring, the second piston ring and the first piston ring are disposed on the piston on a first side of the sealing ring relative to the central axis direction, the fluid pressure cylinder further comprises, on a second side of the sealing ring which is opposite to the first side in the central axis direction:

a further first piston ring that is held in a further first piston ring accommodation groove formed in the circumferential direction in the outer peripheral surface of the piston, and includes a fractured portion which enables a diameter of the further first piston ring to increase and reduce; and a further backup ring that is attached, without being accommodated in a groove, to the outer peripheral surface of the piston between the sealing ring and the further first piston ring, wherein the further backup ring has a first further backup ring end and a second further backup ring end opposite to each other in the central axis direction, the first further backup ring end is kept in constant contact with the sealing ring and, simultaneously, the second further backup ring end is kept in constant contact with the further first piston ring, the piston has first and second axial ends opposite to each other in the center axis direction, the first axial end is on the first side of the sealing ring, and the second axial end is on the second side of the sealing ring, each of the sealing ring accommodation groove, the first piston ring accommodation groove, the second piston ring accommodation groove and the further first piston ring accommodation groove is formed in the outer peripheral surface of the piston between the first and second axial ends, and not at the first and second axial ends, and the outer peripheral surface of the piston has no groove between the further first piston ring accommodation groove and the second axial end.

11. The fluid pressure cylinder as defined in claim 10, wherein the sealing ring comprises an elastically deformable material, each of the first piston ring and the second piston ring comprises a metal material, and the bearing ring comprises synthetic resin.

12. The fluid pressure cylinder as defined in claim 8, wherein the outer peripheral surface of the piston has first and second portions to which the backup ring and the bearing ring are attached, and a third portion between the second piston ring accommodation groove and one of the axial ends of the piston, wherein the third portion extends continuously from the second piston ring accommodation groove all the way to said one of the axial ends of the piston, and the first and second portions of the outer peripheral surface of the piston are at the same radius from the central axis as the third portion of the outer peripheral surface of the piston.

* * * * *